US008197328B2

(12) United States Patent
Bluemel

(10) Patent No.: US 8,197,328 B2
(45) Date of Patent: Jun. 12, 2012

(54) SPECIAL SYMBOL REMAINS IN POSITION UNTIL USED IN A WINNING COMBINATION

(75) Inventor: Guenter Bluemel, Seiersberg (AT)

(73) Assignee: Spielo International Austria GmbH, Lübbecke (DE)

( * ) Notice: Subject to any disclaimer, the term of this patent is extended or adjusted under 35 U.S.C. 154(b) by 930 days.

(21) Appl. No.: 12/238,329

(22) Filed: Sep. 25, 2008

(65) Prior Publication Data

US 2010/0075737 A1 Mar. 25, 2010

(51) Int. Cl.
*A63F 9/24* (2006.01)

(52) U.S. Cl. ..... 463/20; 463/16

(58) Field of Classification Search ..... 463/16, 463/20, 25

See application file for complete search history.

(56) References Cited

U.S. PATENT DOCUMENTS 5,833,537 A * 11/1998 Barrie ..... 463/21
5,997,401 A * 12/1999 Crawford ..... 463/20
6,811,486 B1 * 11/2004 Luciano, Jr. ..... 463/24
7,326,113 B2 2/2008 Bennett et al.
7,331,866 B2 2/2008 Rodgers et al.

* cited by examiner

*Primary Examiner* — Omkar Deodhar
(74) *Attorney, Agent, or Firm* — Patent Law Group LLP; Brian D. Ogonowsky

(57) ABSTRACT

A game involves emulating spinning and randomly stopping virtual reels. If a special symbol is displayed in the matrix, and the special symbol is not used in a winning combination of symbols, then, for the next game, the special symbol is held in its position in the array, and all the reels are spun to randomly display symbols in all positions in the matrix other than in the special symbol position. If the special symbol is used in a winning combination of symbols, the special symbol is not held. The machine may hold the special symbol for an unlimited number of games as long as the player makes a maximum bet or an extra bet. Under certain conditions, an award for a winning combination using the held special symbol is enhanced the longer the special symbol is held without being used, so the player desires to not utilize the special symbol right away.

23 Claims, 5 Drawing Sheets

SPECIAL SYMBOL REMAINS IN POSITION UNTIL USED IN A WINNING COMBINATION

FIELD OF THE INVENTION

This invention relates to gaming machines, such as slot machines, and, in particular, to an added feature for a video reel-type game.

BACKGROUND

Common slot machines randomly select and display an array of symbols on actual or virtual reels, then grant an award to a player based on the occurrence of winning symbol combinations across activated paylines. Common symbol displays include a 5 column/reel by 4 row (5×4) matrix, a 5×3 matrix, a 3×3 matrix, and a 3×1 matrix.

Slot machine manufacturers and casinos have created many different ways to encourage players to bet more, play longer, and play certain machines. Such ways frequently involve designing the game to contain special features. Since the present invention involves symbols being held in place over successive games, certain related prior art is discussed below.

U.S. Pat. No. 7,331,866 to Rodgers describes a special feature involving free games. In one embodiment described in the '866 patent, reels that display a wild symbol during the free games are automatically held until the wild symbol is used in a winning combination or until a certain number of free games are played, whichever is first to occur. Playing free games with such a feature reduces the casino's revenue. The player wants the wild symbol to be used in a winning combination with the minimum number of respins, since there is no advantage to the player in not immediately using the wild symbol in a winning combination, and the player does not want to reach the end of the free game round without taking advantage of the wild symbol.

U.S. Pat. No. 7,326,113 to Bennett holds a special bonus symbol in position for successive games and allows all the reels to spin each game, while the held bonus symbol essentially overlays a spinning reel. Bennett holds the bonus symbol throughout a series of free games and does not extinguish the bonus symbol when it is used in a winning combination during the free games. The Bennett feature is only practical when there are a limited number of free games, since the special symbol must eventually be extinguished. As in the '866 patent, free games reduce the casino's revenues.

What is needed is a "special symbol" retaining feature that encourages the player to play non-free games and provides high revenue to the casino.

SUMMARY

In one embodiment, a special symbol retention feature is only enabled when the player makes the maximum bet on a game. Each game in which the feature is enabled is a paid game.

The gaming machine includes a video screen that displays a plurality of reels, such as 3, 4, or 5 reels. Each reel displays three or more symbols when stopped. In one embodiment, each reel contains at least one special symbol. In another embodiment, only some reels contain a special symbol, such as reels 1, 3, and 5, to reduce the frequency of the special feature. The special symbol may act as a wild card, a scatter symbol of any value (including a wild card), or represent any other function. When a special symbol appears on the video screen, and it is used to create a winning combination of symbols, the player is paid normally, and the special symbol (s) involved in the winning combination is not retained in its position for the next paid game. However, if the displayed special symbol is not used in a winning combination of symbols, the special symbol remains in its position for the next paid game (using a max bet), and all other symbols are selected randomly using the virtual reels. In one embodiment, the special symbol becomes an overlay at its position so that the underlying reel appears to spin normally during the next game. The special symbol is typically more valuable than any other symbol on the reels.

In one embodiment, the special symbol increasingly enhances the award, when used in a winning combination, when the special symbol is held for more and more games. In one embodiment, the special symbol, if used in a winning combination, multiplies the normal award by the number of games the special symbol was held before being used in the winning combination. In another embodiment, multiple special symbols used in a winning combination multiply the normal award. Therefore, the player wants to delay using the specials symbols in a winning combination and will continue to pay a maximum bet to keep the feature enabled, especially when a special symbol is already being held. The requirement of always betting the max bet offsets any added awards due to the special symbol, and the maximum enhanced award can be advertised to draw players to the machine.

In another embodiment, the symbol-stay feature is only enabled when the player makes a special extra bet for enabling the feature.

In another embodiment, the special symbol feature is enabled for each game irrespective of the wager. In another embodiment, the special symbol feature is only enabled after a trigger event, such as a special symbol combination, and the feature is only disabled once all displayed special symbols have been used in a winning combination.

DETAILED DESCRIPTION

Although the invention can typically be implemented by installing a software program in most types of modern video gaming machines, one particular gaming machine platform will be described in detail.

Figure 1:
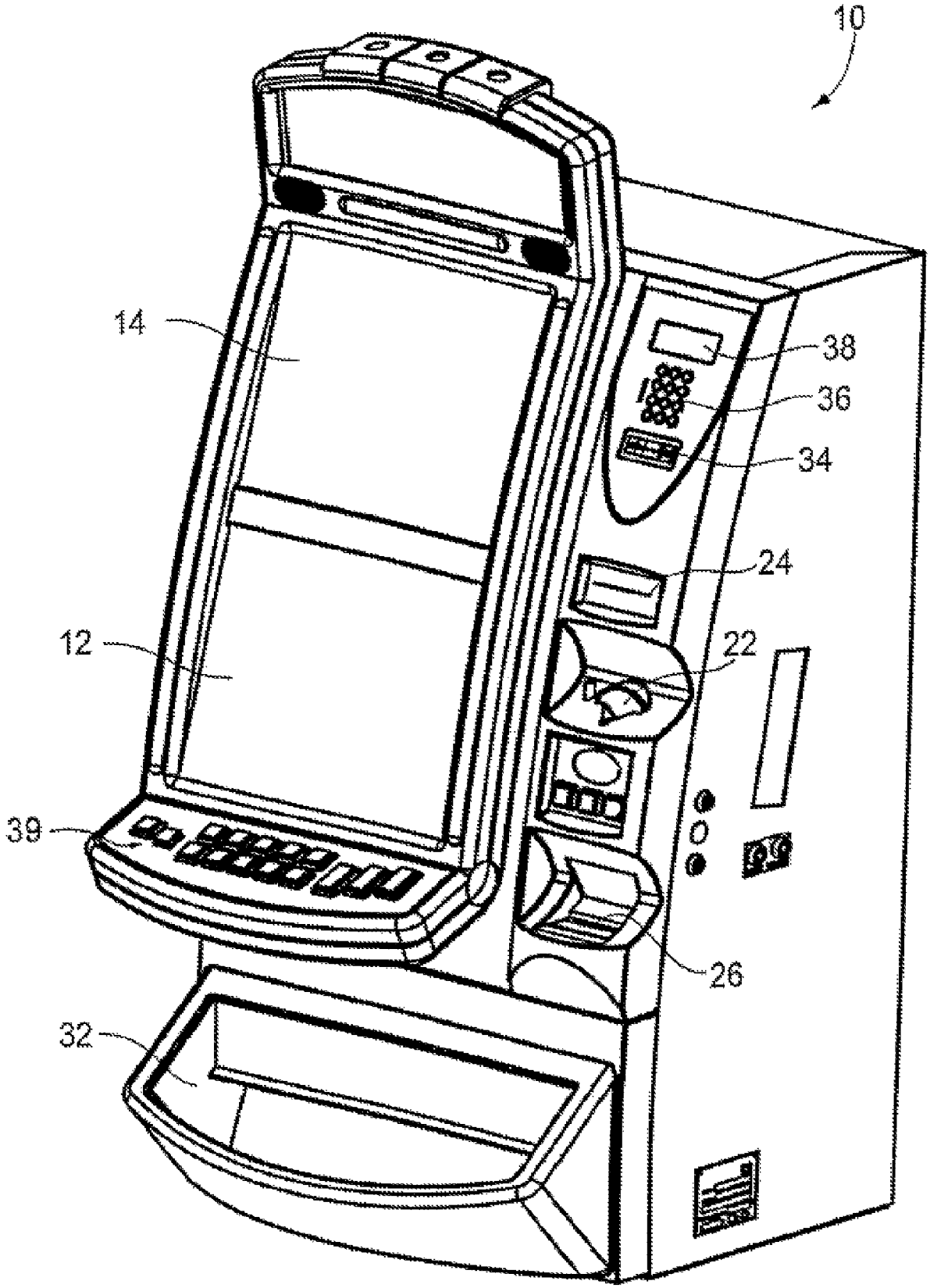
FIG. 1 is a perspective view of one type of gaming machine that is programmed to carry out the inventive technique.

FIG. 1 is a perspective view of a gaming machine 10 that incorporates the present invention. Machine 10 includes a display 12 that may be a thin film transistor (TFT) display, a liquid crystal display (LCD), a cathode ray tube (CRT), or any other type of display. A second display 14 provides game data or other information in addition to display 12. Display 14 may provide information such as an advertisement for the game, the rules of the game, pay tables for each bet amount, the different payline(s) associated with each bet amount to determine winning symbol combinations, or may even display the main game or bonus games along with display 12. Alternatively, the area for display 14 may be a display glass for conveying relevant information.

Display 12 or 14 may have a touch screen lamination that is used to enter player selections.

A coin slot 22 accepts coins or tokens in one or more denominations to generate credits within machine 10 for playing games. An input slot 24 for an optical reader and printer receives machine readable printed tickets and outputs printed tickets for use in cashless gaming. A bill acceptor 26 accepts various denominations of banknotes.

A coin tray 32 receives coins or tokens from a hopper upon a win or upon the player cashing out.

A card reader slot 34 accepts any of various types of cards, such as smart cards, magnetic strip cards, or other types of cards conveying machine readable information. The card reader reads the inserted card for player and credit information for cashless gaming. The card reader may also include an optical reader and printer for reading and printing coded barcodes and other information on a paper ticket.

A keypad 36 accepts player input, such as a personal identification number (PIN) or any other player information. A display 38 above keypad 36 displays a menu for instructions and other information and provides visual feedback of the keys pressed.

Player control buttons 39 include any buttons needed for the play of the particular game or games offered by machine 10 including, for example, one or more bet buttons, a repeat bet button, a spin reels button, a maximum bet button, a cash-out button, a display payout tables button, select icon buttons, and any other suitable button.

Figure 2:
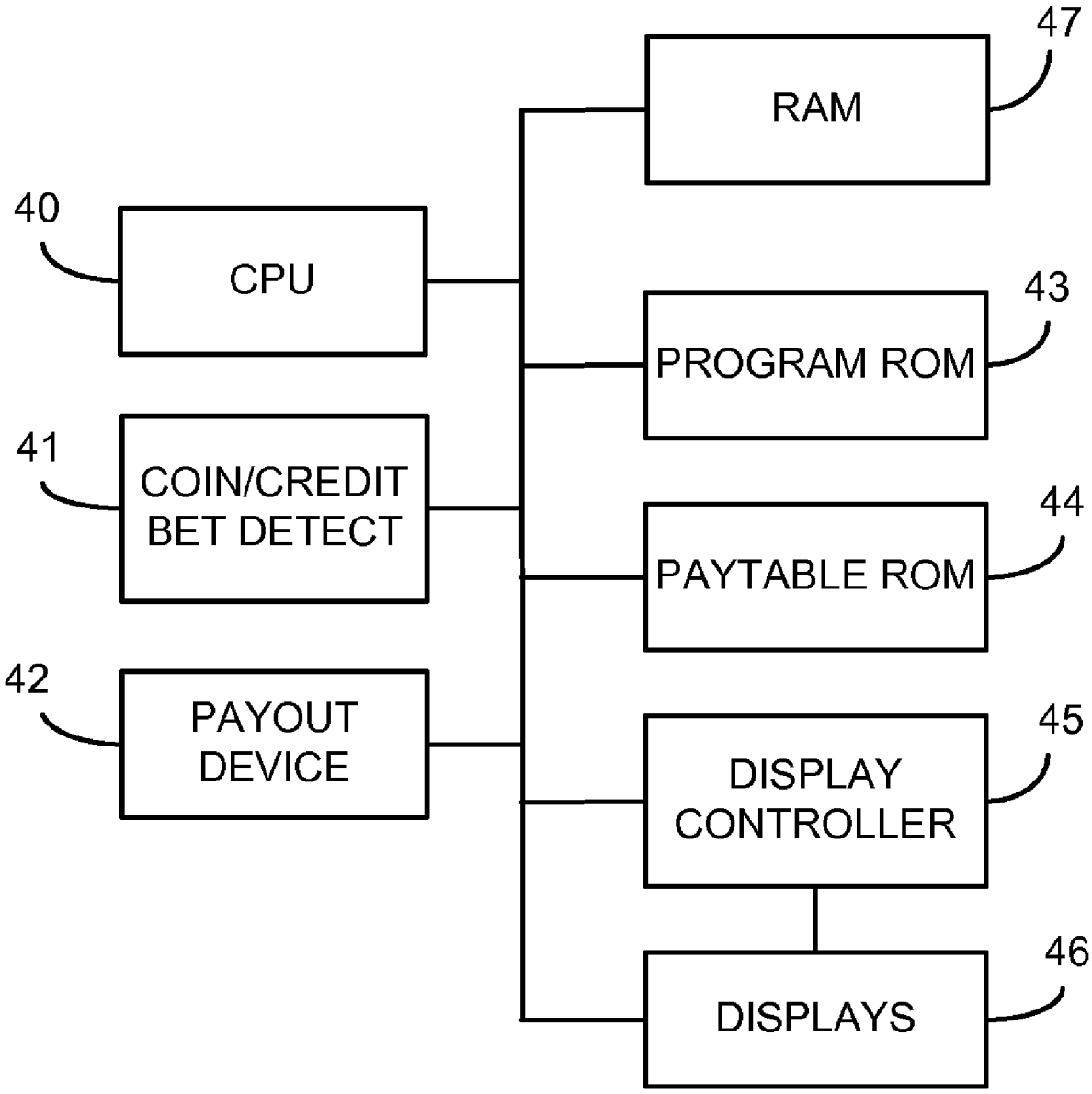
FIG. 2 is a block diagram showing the basic functional units in the gaming machine of FIG. 1.

FIG. 2 illustrates basic circuit blocks in a suitable gaming device. A control unit (CPU 40) runs a gaming program stored in a program ROM 43 (e.g., a CD). A coin/credit detector 41 enables the CPU 40 to initiate a next game. A paytable ROM 44 detects the outcome of the game and identifies awards to be paid to the player. A payout device 42 pays out an award to the player in the form of coins upon termination of the game or upon the player cashing out. A payout may also be in the form of a coded paper ticket, credits on a smart card or magnetic strip card, or in any other form. A display controller 45 receives commands from the CPU 40 and generates signals for the various displays 46. If a display 46 is a touch screen, player commands may be input through the display screen into the CPU 40. A RAM 47 temporarily stores data being accessed by the CPU 40. All components may be connected to a single bus.

Operation of Gaming Machine Incorporating Invention

The operation of the gaming machine of FIG. 1 will be described with respect to the sample screen displays of FIGS. 3A-3D and the flowchart of FIG. 4. The images may be those displayed by display 12 in FIG. 1.

Figure 3A:
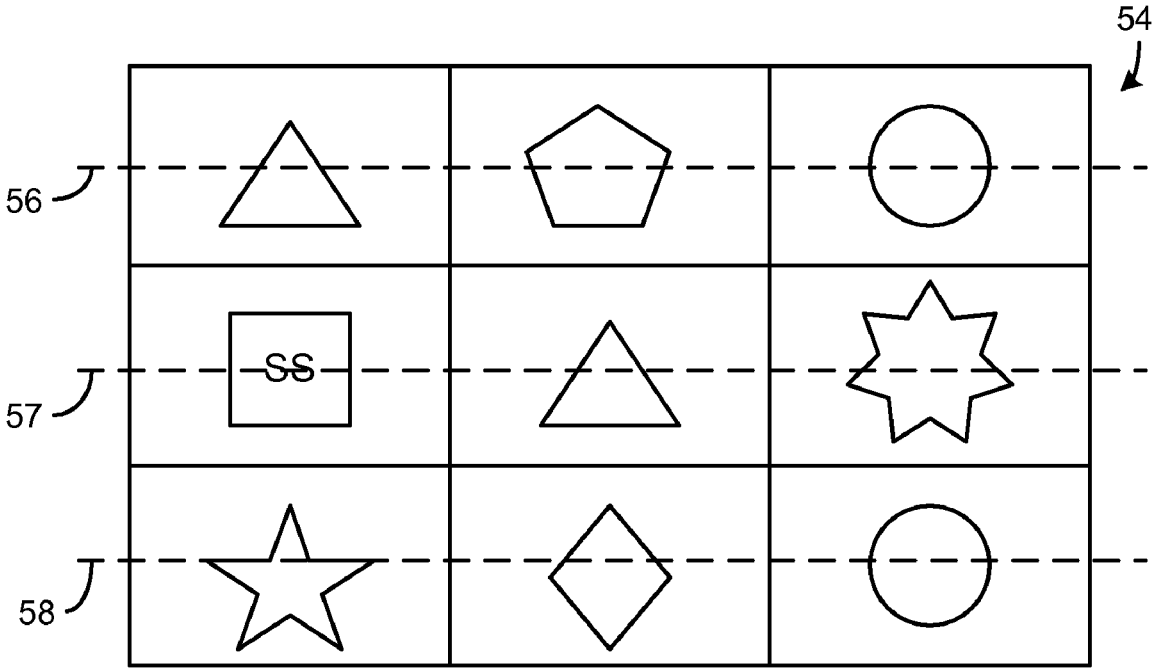
FIGS. 3A-3D illustrate examples of a screen showing a 3×3 matrix of symbols during four successive games in accordance with one embodiment of the invention.

The basic game may be the rotation and random stoppage of three virtual reels 54 displaying a 3×3 matrix of symbols. In a preferred embodiment, the array is a 5-reel×3-column (5×3) array, since there are more possibilities than a 3×3 array. Sample symbols are shown. Awards are based upon whether the symbol combinations across paylines 56, 57, or 58 are winning combinations. Only three horizontal paylines 56-58 are shown in FIG. 3A for simplicity. Normally, there would be many more paylines, including diagonal and zig-zag lines, especially for a 5×3 array. Increasing a bet typically adds paylines or multiplies an award for a winning combination of symbols, or both. In the example, described below, it is assumed the special feature is only made available to a player who had made a maximum bet and thus has enabled all possible paylines. Enabling all paylines provides maximum utilization of the symbol-hold feature of the invention.

The player initially deposits money into the gaming machine, either by cash, ticket, or download, to accumulate credits for later betting. The player then makes a bet for a current game by pressing a bet button one or more times, where each push of the button adds another credit to the bet. There may be a dedicated max-bet button to simplify betting the maximum bet.

Figure 4:
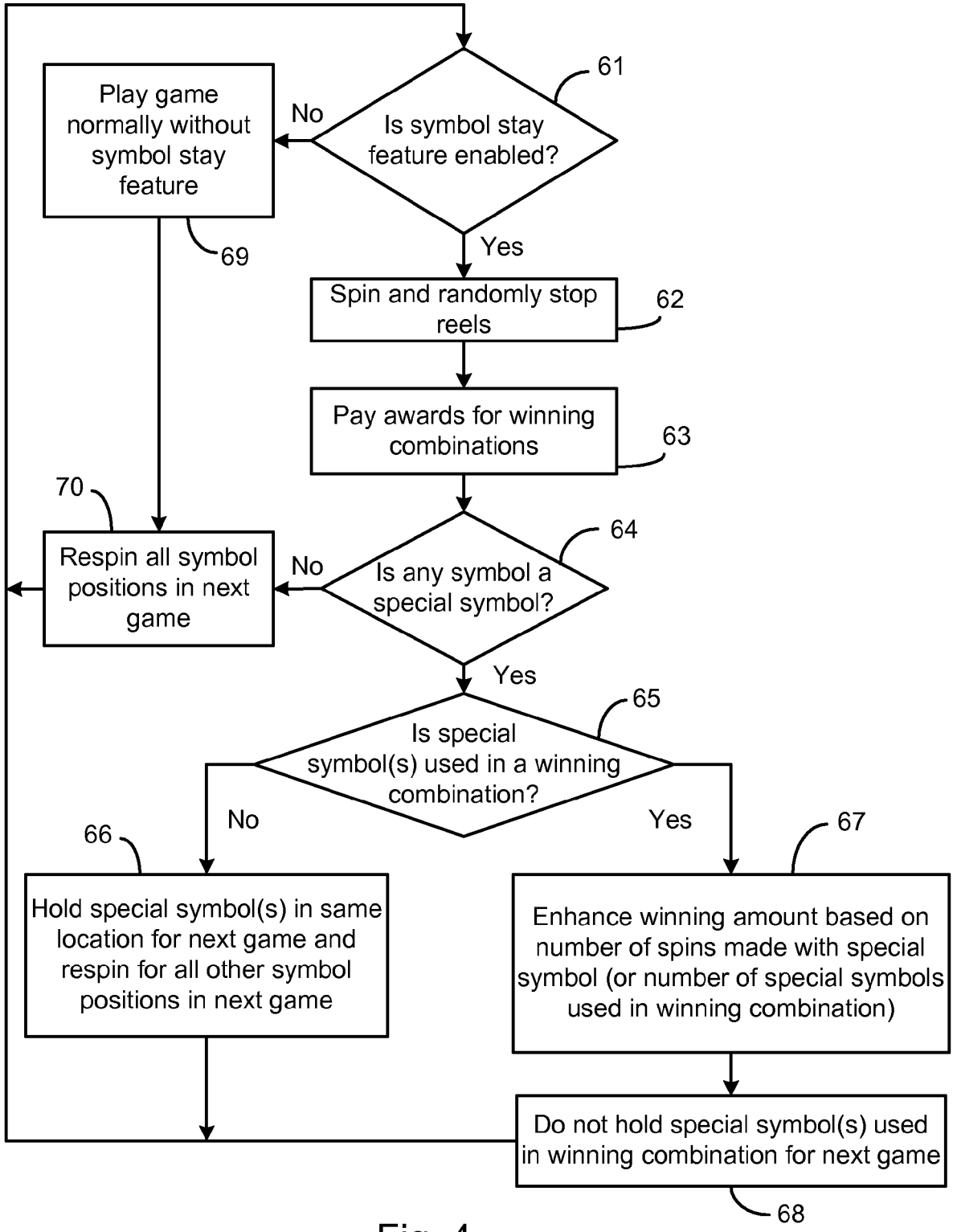
FIG. 4 is a flow chart of the basic method carried out using the new technique.

In step 61 of FIG. 4, the CPU determines whether the symbol-stay feature is enabled by determining if the maximum bet has been made. It is assumed the maximum bet has been made. In another embodiment, the special feature is enabled for all games irrespective of the bet. In another embodiment, the special feature is enabled after a triggering event such as a special symbol outcome of a previous game or other event.

In step 62, the player presses a spin reels button, and all the reels spin and pseudo-randomly stop. The terms random and pseudo-random are given the same meaning in this disclosure.

FIG. 3A illustrates the screen showing the randomly selected 3×3 array of symbols after step 62.

In step 63, any award is granted based on winning symbol combinations across activated paylines and may also be based on the amount bet. In some types of games, an increased bet increases the award proportionally. In other types of games, an increased bet increases the number of activated paylines and may not affect the award amount. In any event, an increased bet is beneficial to the player due to increased awards or increased odds of winning.

In the example of FIG. 3A, there are no winning combinations, so the player receives no award. One of the symbols (symbol SS) displayed is a special symbol. Each or the reels includes one or more special symbols. The special symbol may represent a wild symbol (all symbols), a scatter symbol (including a wild card scatter symbol), a trigger symbol for a bonus game or free games or a jackpot, the highest value award symbol, or other special function. A scatter symbol is a symbol that can be combined with symbols in other columns irrespective of the scatter symbol's payline.

In the example, it is assumed that the special symbol SS is a wild symbol. The player would normally be upset that a wild symbol was wasted by not being involved in a winning combination. With the symbol-stay feature, the special symbol is held at its position for subsequent games until it is used in a winning combination. In step 64, it is determined whether a special symbol was displayed in the game. In the example of FIG. 3A, the answer is yes.

In step 65, it is determined whether the special symbol is used in a winning combination. In the example of FIG. 3A, the answer is no.

In step 66, the CPU 40 (FIG. 2) controls the game so that, after the player makes another max-bet wager and spins the three reels 54, the special symbol SS remains in its current position. This can be accomplished by creating the special symbol SS as an overlay and allowing the leftmost virtual reel to rotate under the special symbol SS so that any resulting symbol below the overlaid special symbol is substituted by the special symbol. In one embodiment, if the reel symbol below the overlaid special symbol is again a special symbol, any resulting award would be doubled (or enhanced in some way) when the special symbol were eventually used in a winning combination. The other two reels rotate in a normal fashion.

Figure 3B:
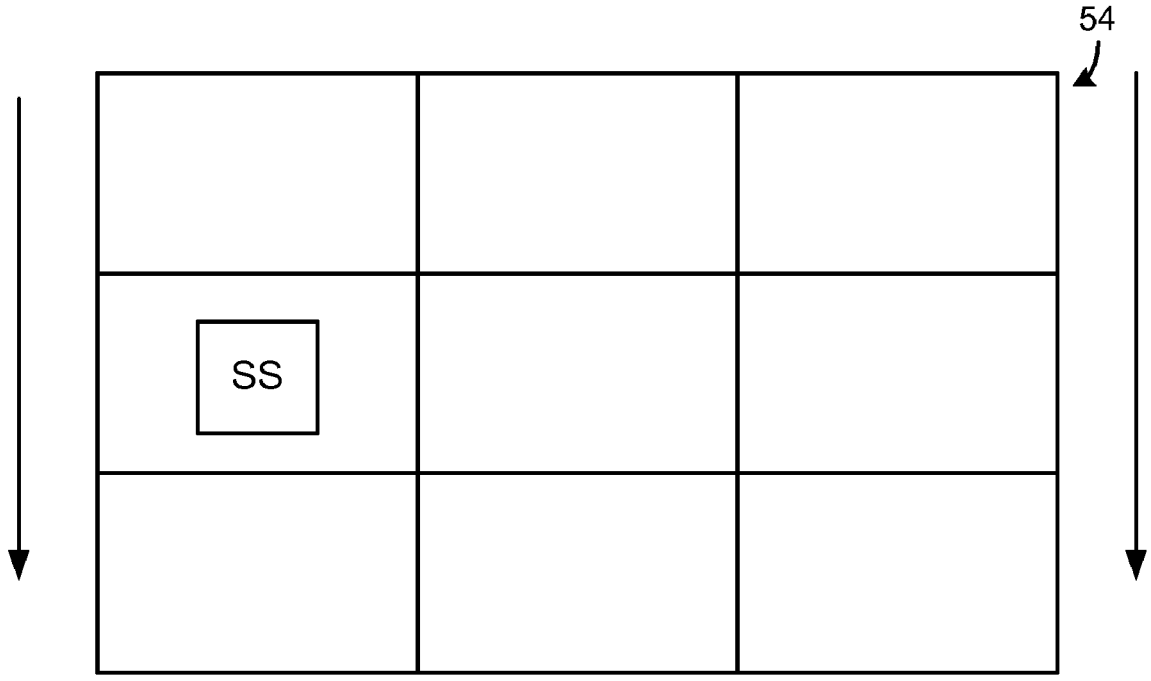

FIG. 3B illustrates that all three reels 54 are rotating in a downward direction while the special symbol SS is held in position, assuming the max bet has been made for the game.

Figure 3C:
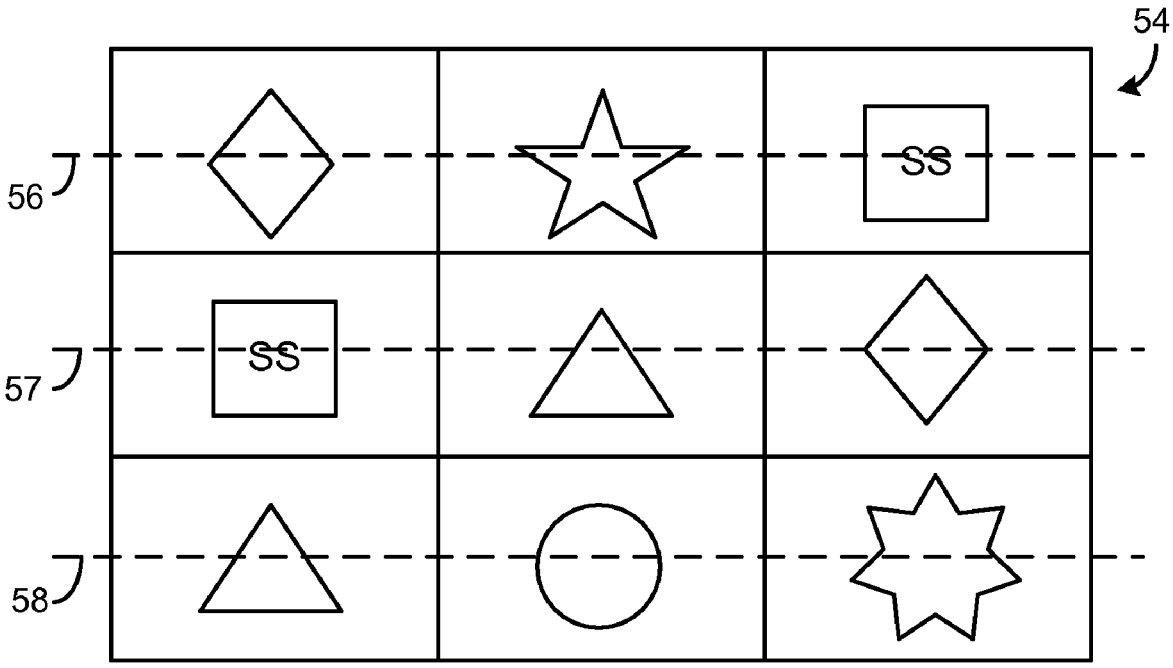

FIG. 3C illustrates the array after the reels 54 have randomly stopped. In FIG. 3C, another special symbol SS has appeared on the rightmost reel. Even though the special symbols are wild, there is still no winning combinations created, so all the displayed special symbols SS are again held for the next game, while the underlying reels spin, assuming the player made a max bet.

Figure 3D:
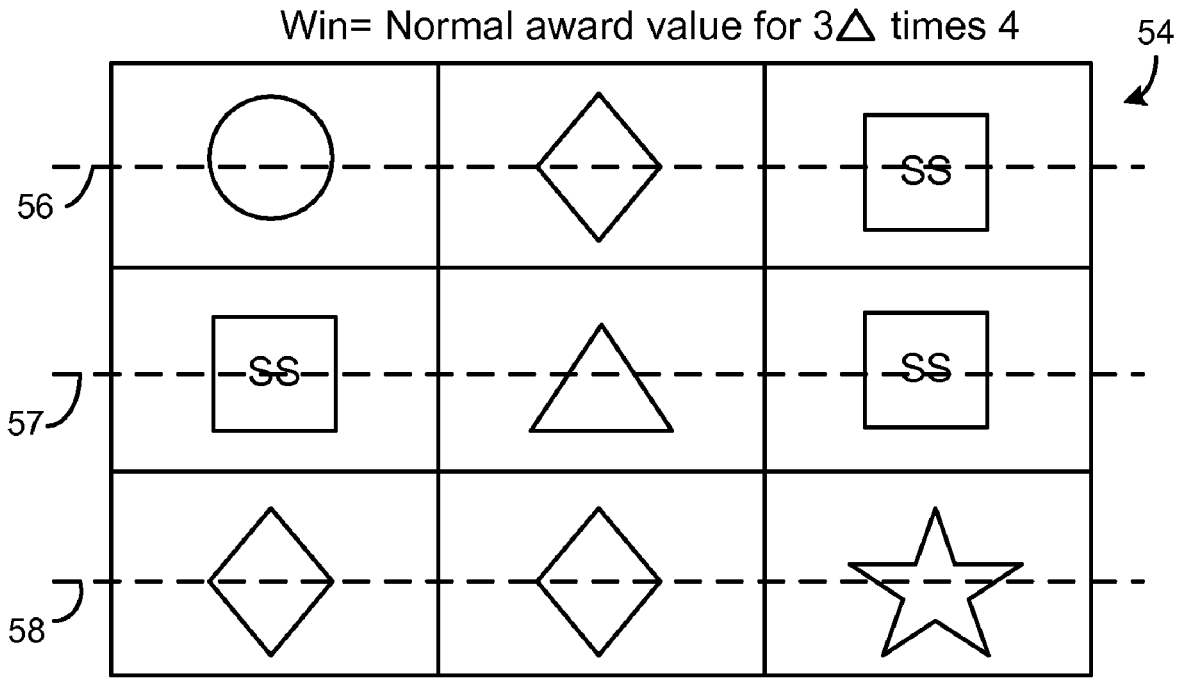

FIG. 3D illustrates the array after the reels have spun and randomly stopped. A third special symbol SS appeared in the center of the rightmost reel, creating a winning combination of three triangles across the center payline 57. In one embodiment, the player only gets the normal award for three triangles, and the special symbols used in the winning combination are no longer held for the next reel spin. In another embodiment, the special symbols effectively increase in value the longer they are displayed but not used in a winning combination to further increase player excitement and promote the betting of a max bet per game. A held special symbol acts as a multiplier of the award, when used in a winning combination. In one embodiment, each additional game using a held special symbol causes that special symbol to increase the award multiplier by one when that particular special symbol is used in a winning combination. For example, since the special symbol SS on the leftmost reel in FIG. 3D was held for two games, the award for the three triangles is multiplied by 2. In a further embodiment, the award is also multiplied by the number of special symbols involved in the winning combination. So in the example of FIG. 3D, the leftmost special symbol multiplied the award by 2, and the fact that two special symbols were involved in the combination further multiplied the award by 2. Therefore, the player wins four times the normal award for three triangle symbols. Obtaining a combination of three special symbols may award a special jackpot. The special symbol feature can theoretically increase an award to a very high amount so this becomes an advertising draw for the machine.

In step 67, the award is enhanced, and the two special symbols are then not held for the next game (step 68). The top right special symbol SS will still be held since it was not involved in any winning combination. The player will not want to cash out of the machine if there are any special symbols remaining and will continue to make max bets.

If the symbol-stay feature is not enabled (step 61), or if no special symbols are displayed (step 64) the game is a normal game (steps 69, 70).

In another embodiment, the symbol-stay feature is only enabled when the player makes a special extra bet for enabling the feature. For example, the player bets one amount to play the normal game, and there may be an extra button on the console that, when pressed, enables the symbol-stay feature for that game and deducts a certain number of credits for the feature. For example, the extra bet may be double the player's bet on the normal game. The player's normal bet would typically control the number of paylines and base payouts.

The symbol-stay feature can also be applied to a series of free games. The operation of each game would be the same as above except that the feature is enabled without the player betting a max bet or an extra bet.

In another embodiment, only some reels contain a special symbol, such as reels 1, 3, and 5 (in a 5×3 or 5×4 matrix machine), to reduce the frequency of the special feature.

As seen, the symbol stay feature may be continuously enabled for paid games, and player satisfaction is very high since no special symbol is wasted except by the player's own action in not betting a max bet. Any additional payouts by the machine due to the special symbols are offset by the player wagering a maximum bet for each game to enable the feature.

The various techniques described are easily implemented by a software programmer storing a program in the program ROM 43 in FIG. 2. The CPU 40 carries out the program, as would be understood by those skilled in the art. Although an embodiment using a 3×3 matrix has been shown, the invention is also applicable to a 5×4, 5×3, 3×1, or other size matrix of symbols.

The technique may be carried out on a stand-alone machine or on a machine connected to a server.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method performed by a gaming device, the gaming device comprising a processor executing instructions stored in memory, comprising:

emulating spinning and randomly stopping virtual reels to display symbols in a matrix of symbol positions;

granting any awards to a player based upon winning combinations of symbols displayed in the matrix, some of the symbols on the reels being special symbols;

if a special symbol is displayed in a position in the matrix, and the special symbol is not used in a winning combination of symbols, then, for a next game, holding the special symbol in its position in the matrix and spinning all reels to randomly display symbols in all positions in the matrix other than in the special symbol position, wherein the machine may continue to hold the special symbol for an unlimited number of games until used in a winning combination as long as an enabling condition is met;

if a special symbol is displayed in a position in the matrix, and the special symbol is used in a winning combination of symbols, then, for a next game, spinning all reels to randomly display symbols in all positions in the matrix; and enhancing an award for a winning symbol combination containing one or more held special symbols when a certain condition occurs, wherein conducting multiple games while a special symbol is held without being used in a winning combination increases chances of the certain condition occurring.

2. The method of claim 1 wherein the special symbol is a wild symbol.

3. The method of claim 1 wherein the special symbol is a scatter symbol.

4. The method of claim 1 wherein the certain condition comprises a symbol on a reel, after the reel is spun and stopped, at a first matrix position being another special symbol that aligns with a previously held special symbol at the first matrix position.

5. The method of claim 1 wherein the certain condition comprises obtaining a winning combination of symbols that includes a special symbol that has been held for at least one spin of the reels.

6. The method of claim 5 wherein the certain condition comprises obtaining a winning combination of symbols that includes a special symbol that has been held for at least two spins of the reels.

7. The method of claim 1 wherein the certain condition comprises obtaining a winning combination of symbols that includes a special symbol that has been held for at least one spin of the reels, wherein a multiplier of an award for a winning combination of symbols including the special symbol depends on a number of games that the special symbol is held.

8. The method of claim 1 wherein the certain condition comprises obtaining a winning combination of symbols that includes a plurality of special symbols.

9. The method of claim 1 further comprising the player placing a maximum bet to play a game, wherein the enabling condition for holding the special symbol in its position in the matrix until it is used in a winning symbol combination is if the player placed a maximum bet for at least the game in which the special symbol is displayed in the matrix.

10. The method of claim 1 further comprising the player placing an extra bet, in addition to a bet for spinning and randomly stopping the virtual reels, wherein the enabling condition for holding the special symbol in its position in the matrix until it is used in a winning symbol combination is if the player placed an extra bet for at least the game in which the special symbol is displayed in the matrix.

11. The method of claim 1 wherein the enabling condition occurs automatically for every game.

12. The method of claim 1 wherein the enabling condition is a triggering event based on a certain symbol combination occurring.

13. A method performed by a gaming device, the gaming device comprising a processor executing instructions stored in memory, comprising:

emulating spinning and randomly stopping virtual reels to display symbols in a matrix of symbol positions;

granting any awards to a player based upon winning combinations of symbols displayed in the matrix, some of the symbols on the reels being special symbols;

if a special symbol is displayed in a position in the matrix, and the special symbol is not used in a winning combination of symbols, then, for a next game, holding the special symbol in its position in the matrix and spinning all reels to randomly display symbols in all positions in the matrix other than in the special symbol position, wherein the machine may continue to hold the special symbol for an unlimited number of games until used in a winning combination as long as an enabling condition is met; and if a special symbol is displayed in a position in the matrix, and the special symbol is used in a winning combination of symbols, then, for a next game, spinning all reels to randomly display symbols in all positions in the matrix.

14. The method of claim 13 wherein the special symbol is a wild symbol.

15. The method of claim 13 wherein the special symbol is a scatter symbol.

16. The method of claim 13 further comprising enhancing an award for a winning combination of symbols including a held special symbol, wherein a level of enhancement increases as additional games are played while the special symbol is held before being used in a winning combination of symbols.

17. The method of claim 13 further comprising the player placing a maximum bet to play a game, wherein the enabling condition for holding the special symbol in its position in the array until it is used in a winning symbol combination is if the player placed a maximum bet for at least the game in which the special symbol is displayed in the matrix.

18. The method of claim 13 further comprising the player placing an extra bet, in addition to a bet for spinning and randomly stopping the virtual reels, wherein the enabling condition for holding the special symbol in its position in the matrix until it is used in a winning symbol combination is if the player placed an extra bet for at least the game in which the special symbol is displayed in the matrix.

19. The method of claim 13 wherein the enabling condition occurs automatically for every game.

20. The method of claim 13 wherein the enabling condition is a triggering event based on a certain symbol combination occurring.

21. A gaming machine comprising:

a display device for displaying a game; and at least one programmed processor for carrying out a game program and controlling the display, the processor carrying out the method comprising:

emulating spinning and randomly stopping virtual reels to display symbols in a matrix of symbol positions;

granting any awards to a player based upon winning combinations of symbols displayed in the matrix, some of the symbols on the reels being special symbols;

if a special symbol is displayed in a position in the matrix, and the special symbol is not used in a winning combination of symbols, then, for a next game, holding the special symbol in its position in the matrix and spinning all reels to randomly display symbols in all positions in the matrix other than in the special symbol position, wherein the machine may continue to hold the special symbol for an unlimited number of games until used in a winning combination as long as an enabling condition is met; and if a special symbol is displayed in a position in the matrix, and the special symbol is used in a winning combination of symbols, then, for a next game, spinning all reels to randomly display symbols in all positions in the matrix.

22. The machine of claim 21 wherein the enabling condition for holding the special symbol in its position in the matrix until it is used in a winning symbol combination is if the player placed a maximum bet for at least the game in which the special symbol is displayed in the matrix.

23. The machine of claim 21 wherein the enabling condition for holding the special symbol in its position in the matrix until it is used in a winning symbol combination is if the player placed an extra bet for at least the game in which the special symbol is displayed in the matrix.

* * * * *